US009789724B2

(12) United States Patent
Jiang et al.

(10) Patent No.: US 9,789,724 B2
(45) Date of Patent: Oct. 17, 2017

(54) OPTICAL SECURITY DEVICE AND SYSTEM AND FABRICATION METHODS THEREOF

(71) Applicants: Yingqiu Jiang, Sunnyvale, CA (US); Aharon Hochbaum, Berkeley, CA (US)

(72) Inventors: Yingqiu Jiang, Sunnyvale, CA (US); Aharon Hochbaum, Berkeley, CA (US)

(73) Assignee: OPTHENTIC CORP., Santa Clara, CA (US)

( * ) Notice: Subject to any disclaimer, the term of this patent is extended or adjusted under 35 U.S.C. 154(b) by 342 days.

(21) Appl. No.: 14/053,570

(22) Filed: Oct. 14, 2013

(65) Prior Publication Data

US 2014/0103633 A1 Apr. 17, 2014

Related U.S. Application Data

(60) Provisional application No. 61/714,093, filed on Oct. 15, 2012.

(51) Int. Cl.

| | |
|---|---|
| ***B42D 15/00*** | (2006.01) |
| ***B42D 25/425*** | (2014.01) |
| ***B42D 25/364*** | (2014.01) |
| ***B42D 25/391*** | (2014.01) |

(52) U.S. Cl.

CPC ..... *B42D 15/0093* (2013.01); *B42D 25/364* (2014.10); *B42D 25/391* (2014.10); *B42D 25/425* (2014.10)

(58) Field of Classification Search

CPC ..... B42D 15/0093; B42D 25/425; B42D 25/364; B42D 25/391

See application file for complete search history.

(56) References Cited

U.S. PATENT DOCUMENTS

| | | | | |
|---|---|---|---|---|
| 5,353,141 | A * | 10/1994 | Onuma | G02F 1/133784 349/126 |
| 6,133,980 | A * | 10/2000 | Faris | B82Y 15/00 349/175 |
| 6,144,428 | A | 11/2000 | Schadt et al. | |
| 6,740,472 | B2 | 5/2004 | Karasev | |
| 7,292,292 | B2 | 11/2007 | Schadt et al. | |
| 2010/0002177 | A1 * | 1/2010 | Chien | G02F 1/13378 349/124 |

OTHER PUBLICATIONS

Actinic Radiation, http://www.thefreedictionary.com/actinic+radiation, last visited Mar. 17, 2017.*

* cited by examiner

*Primary Examiner* — James Mellott

(57) ABSTRACT

The present invention relates generally to an optical security device and an optical security system in which hidden images that are invisible to the naked eye under unpolarized illumination, become visible under either linearly or circularly polarized illumination. Preferred fabrication methods of said optical security device are disclosed.

8 Claims, 4 Drawing Sheets

1a

1b

OPTICAL SECURITY DEVICE AND SYSTEM AND FABRICATION METHODS THEREOF

CROSS-REFERENCE TO RELATED APPLICATION

The present application is related and claims the priority under 35 U.S.C. §§119(e) to U.S. provisional patent application No. 61/714,093 entitled "Optical Security Device and System and Fabrication Methods Thereof" filed on Oct. 15, 2012.

BACKGROUND OF THE INVENTION

Many standard light sources such as lights in buildings are essentially unpolarized. Images that are hidden when viewed with unpolarized light but can be revealed to observers using simple means of detection such as polarizers are useful tools for covert security marking, security printing and tagging applications. In addition, security markings that are visible to the naked eye but their appearance vary with changing the polarization states of the illumination are important too.

In U.S. Pat. No. 6,740,472, Karasev described a security latent (hidden) image system of which the hidden information can be revealed by using a circular polarizing filter. However, due to the nature of the invention, this security marking system is limited only to markings on essentially specular reflective substrate, such as a metallic coating, which is a sever limitation on the possible applications. In addition, the method of image formation requires a complicated process of UV radiation through a specially manufactured mask.

US patents (Schadt, et al.) U.S. Pat. Nos. 6,144,428 and 7,292,292 B2 describe a complicated system of three different layers comprising a cholesteric liquid crystal polymer layer, a linear-photo-polymerization (LLP) alignment layer, and a (nematic) liquid crystal polymer structured (patterned) retarder layer. Hidden images are written in the LLP layer by exposing the relevant parts to different orientations of linearly polarized UV radiation via masks. Such images are generally not visible under unpolarized light, but become visible when viewed through linear polarizers. There is no limitation on choice of substrates.

Both of the above-mentioned technologies require the complicated, expensive and slow processes of photo radiation through specially prepared masks. In the case of U.S. Pat. No. 6,740,472, the substrates are limited to metallic or metallic-like; in the case of Schadt, multiple layers of coatings, and multiple UV exposure steps are required. Since the above security systems require masks they are useful for manufacturing of identical security marks but are not practical if the marks are required to be changed frequently. In particular, they are not practical if each mark has to be different from all other marks as in serial numbers marks.

The above shortcomings can be overcome by a method disclosed by Faris in U.S. Pat. No. 6,133,980. In this patent, an optical element comprises a surface retarder on a liquid crystal film, such as cholesteric liquid crystal polymer (CLCP) film, is described. Also disclosed, but not claimed, are three methods of making such optical element. Compare to Karasev and Schadt, this prior art offers a much simpler way of creating hidden images in a single layer of polymer. However, U.S. Pat. No. 6,133,980 lacks sufficient information on the fabrication process for making such optical elements and it is not very useful for practical applications.

The current invention teaches fabrication processes that are reproducible for fabricating the above-mentioned optical element of good quality and at low cost. Specifically, the current invention teaches the fabrication of optical security devices using our improved fabrication process. The hidden images are patterned directly on the top surface of the CLCP, and are embedded in the CLCP film by locally modifying the alignment of the cholesteric molecules in desirable directions to create optical retarders on the surface. Creating multiple retarders with axes at different directions allows the creation of multiple hidden images in a single layer. The hidden images are detectable by viewing the optical security device through either linear or circular polarizers. Alternatively, polarized light sources can be used (polarizer is located near the light source) and, therefore, can be viewed directly without having to look through a polarizer. Our invention thus allow to fabricate covert marks in a single layer and doing so in a way that is compatible with roll-to-roll process that are essential to reduce the fabrication cost of the security devices.

SUMMARY OF THE INVENTION

The present invention is related to methods of making an optical security device which comprises a single layer of modified CLCP coating with hidden (latent) images embedded inside the said layer. The invention further extends to an optical security system which comprises the said optical security device and simple means of detection such as polarizers or polarized light source.

DETAILED DESCRIPTION OF THE INVENTION

The basic optical security device of the invention is based on a chiral nematic or cholesteric liquid crystal polymer (CLCP) film (as the two are indistinguishable for the purpose of this invention we'll refer to them as CLCP film throughout the text), where at least part of one film surface is modified to function as an optical retarder with its optical axis essentially in the plane of the surface. The modified area can consist of distinct regions on the surface, each having optical axis in an arbitrary direction within the surface. In practical applications the optical security device will include also a substrate and optically isotropic overcoat layer. A wide variety of substrates can be used such as paper, plastic films, metallic foils, holographic metallic films, etc. The substrate provides protection, integrity and its opposite surface can be used to attach the optical security device to articles of interest using adhesive. The functions of the overcoat layer are to protect the invented optical security device from environmental factors that can degrade the hidden images and to avoid deliberate attempts to modify, erase or temper in any other way with the covert images. The overcoat layer has to be essentially optically isotropic so as not to modify any polarized incident light used during the authentication process. Note that the optical security devices of this invention are essentially transparent and thus can be overlaid on a printed material without obstructing the readability of the print.

Figure 1:
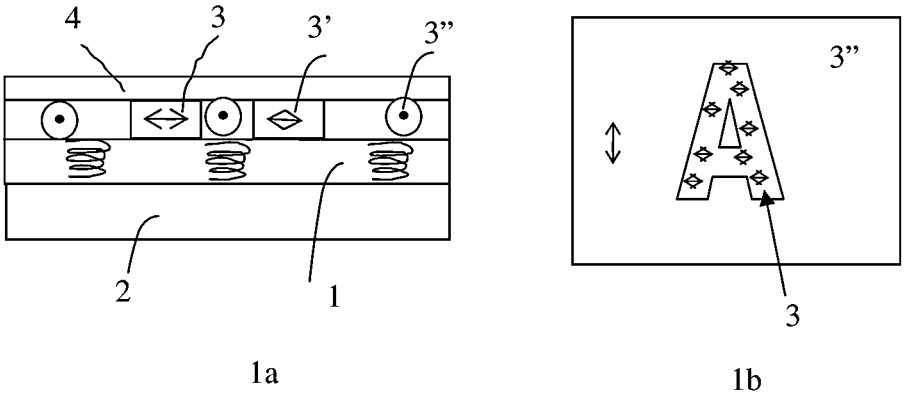
FIGS. 1*a* and 1*b* illustrate respectively a cross sectional view and the top view of the basic structure of a single-layer CLCP film that contains two distinct surface-modified optical phase retarders throughout the entire area.

FIG. 1*a* shows an example of a cross-section of the basic structure of a single-layer CLCP film 1 which contains surface-modified phase retarders. The CLCP film 1 is coated on top of a substrate 2. In areas 3, 3' and 3" on the surface opposite to the substrate, the directions of the CLC molecules are modified so as to act as linear retarders with well-defined optical axes in the plane of the surface. An optically clear and isotropic material 4 is coated on top of the modified CLCP film. In the example in FIG. 1*a*, the direction of the optical axis in area 3 is in the plane of the page; the optical axis in area 3" is perpendicular to the plane of the page. The optical axis of area 3' (a shorter arrow) is in an arbitrary direction anywhere between the previous two, and is confined to the plane of the CLCP surface. Mechanical processes are used to modify the CLC structure 1 into any of the linear retarder structures 3 or 3' or 3".

FIG. 1*b* is a top view of one particular case of FIG. 1*a*. One surface of the CLCP film is modified such that the optical axis within the area of the letter "A" (3) is perpendicular to the optical axis of the background area (3"). Under unpolarized illumination the modification of the surface into retarders with different optical axes orientations has no impact on intensity modulations, therefore it is impossible to visually distinguish between the two different retarders. As a result, the letter "A" will remain invisible to the naked eye.

A special case is one where the whole area of the label is modified uniformly so it acts as a single uniaxial phase retarder on top of the CLCP. When the phase retardation is $\pi/2$ (quarter wave retarder), the invented optical security device possesses all the optical properties of the CLCP with an exception that it reflects linearly polarized light instead of circularly polarized light. This feature is particularly useful for applications where linearly reflective polarizers are required. One good example is the brightness enhancement film (for light recycling) for LCD backlighting unit. When a CLCP film is used as a recycling reflector, it requires an additional quarter-wave retarder film to reflect linearly polarized light. The current invention eliminates the need for a separate quarter-wave film and, therefore, is much more cost-effective.

Figure 2:
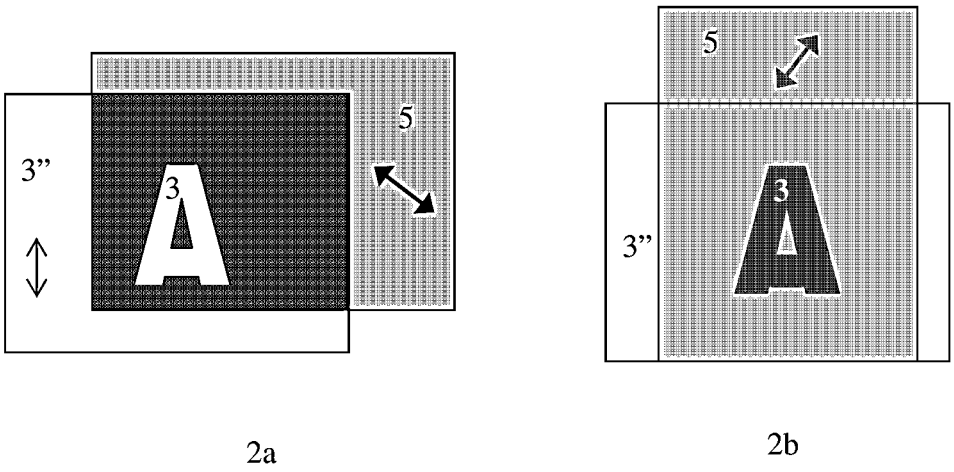
FIGS. 2*a* and 2*b* are the top view of a single-layer CLCP film that contains two distinct surface-modified retarders covering the entire area. The retarders are observed through a linear polarizer that is parallel to the polarization of the reflected light from the hidden mark "A" (2*a*) or perpendicular to it (2*b*).

Referring now to FIGS. 2*a* and 2*b*, when the invented optical security device described in FIG. 1*b* is viewed through a linear polarizer 5, the hidden letter "A" becomes visible to the naked-eye. FIGS. 2*a* and 2*b* illustrate the reversal of contrast between the background and the letter 'A" when the viewing linear polarizer is rotated by 90°. The brightness of the reflected signal depends on the value of the retardation and direction of the optical axis. In one preferred embodiment the maximum brightness is be achieved when the surface-modified retarder functions essentially as a quarter wave plate for wavelengths within the CLCP reflection band. If the incident light is linearly polarized at +45° or −45° to the optical axis it will be transformed by the retarder into essentially right-handed (RH) or left-handed (LH) circular polarizations respectively. Light polarized by a polarizer at other angles will be transformed into elliptical polarization which can be considered as a linear combination of RH and LH polarizations.

Assume for example that the CLCP reflects LH polarized light around 550 nm (green) and that the optical axis within the letter "A" is at −45° to the linear polarizer. A quarter-wave retarder that makes the letter "A" will transform the incident linear polarization into a LH circular polarization which will be fully reflected by the underlying CLCP. "A" will be seen, therefore, as a bright green letter (2*a*). The background (3"), where the retarder's optical axis is at +45° to the polarizer, will transmit rather than reflect all wavelengths within the reflection band. The transmitted green light can be either absorbed by a black substrate or diffusively reflected by a white substrate. In either case the background will appear darker than the letter "A". Therefore, if one views the optical security device (1*b*) through a polarizer (2*a*) at a specular angle to the light source, one will observe a significant contrast of the green light reflection between the "A" and its background. The letter "A", which was hidden when viewed with unpolarized illumination (1*b*), becomes visible simply by laying a linear polarizer over the invented optical security device. The action of adding a linear polarizer to the optical security device transformed the phase modulation within the device surface (which invisible to the naked eye) into intensity modulation which is easily detectable by a naked eye. If the linear polarizer is rotated by 90° as in 2*b* the contrast will be inverted: the intensity of the green reflection from the letter "A" will become significantly lower than the intensity reflected from the background.

The combination of a polarizer and the optical security device is considered here as an "optical security system". While the security system can be as simple as laying a polarizer over the optical security device, it can take more subtle forms. One other non-obvious embodiment for a security system is to place the linear polarizer near the light source and far away from the optical security device. As a result the observer will view the device without an intervening polarizer between the device and the observer. It can be shown that it is sufficient to polarize linearly just the incident illumination (but not the reflected light) to achieve detectable intensity contrast between the two different retarders in 1*b*. In practice, however, using a linear polarizer to polarize both the incident illumination and the reflected light produces higher intensity contrast between the different retarders.

It should be noted that the CLCP functions as a polarization filter for wavelengths within the reflection band: fully reflecting one circular polarization while fully transmitting the other. As a result it is not necessary to overlay the linear polarizer on the optical security device to achieve a contrast in the reflection intensity between different sub-areas. An even preferred embodiment is the one where the linear polarizer only polarizes the incident light, and thus can be in proximity to the light source. The observer then can detect the hidden images directly. This embodiment has the advantage that the bright images are brighter compared to the overlay configuration. An additional advantage is that the act of level #2 authentication can be covert too as the presence of the detection tool—the linear polarizer—is hidden.

Figure 3:
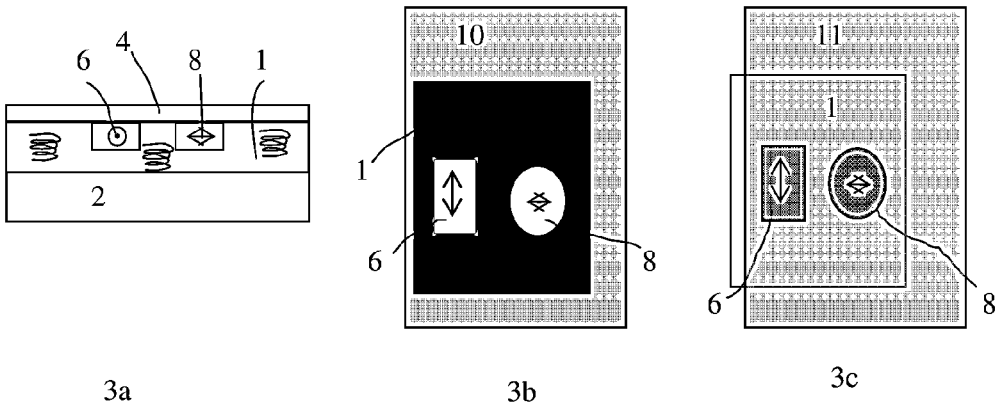
FIG. 3*a* depicts a cross sectional view of a single-layer CLCP film containing two distinct surface-modified retarders covering only in part of the area.
FIGS. 3*b* and 3*c* are the top views of a single-layer CLCP film containing two distinct surface-modified retarders in part of the area as they are seen through a circular polarizer. The handedness of the circular polarizer is either opposite to the circular polarization that is reflected from the unmodified areas (3*b*), or the same (3*c*).

In another preferred embodiment, as depicted in FIGS. 3*a*, 3*b*, and 3*c*, only part of the surface area of the CLCP is modified to function as a uniaxial retarder with its axis in the plane of the CLCP surface. The rest of the area has no retarder at all and acts only as a reflective circular polarizer for wavelengths within the reflection band. Of particular interest are cases where the retarder takes shapes like letters, numbers, bar code or line drawings. Such latent images remain hidden under unpolarized illumination. They become visible, however, with the use of a circular polarizer.

Referring now to FIG. 3*a*, a cross-sectional view of the invented optical security device, where CLCP in areas 6 and 8 are surface-modified while the rest of the area (1) is not modified. A substrate 2 and an optically isotropic clear coating 4 serve respectively as the support and protection layers for the CLCP layer. Under unpolarized illumination there is no difference in the appearance of areas 6 and 8, and the background. However, when the incoming light is circularly polarized (as shown in FIGS. 3*b*, and 3*c* where a circular polarizer is overlaid on the sample), the surface-modified areas 6 and 8 have distinctive contrast to the background 1. FIG. 3*b* is an example where a LH polarizer 10 overlaying a RH reflecting CLCP film where only areas 6 and 8 are surface-modified retarders. The background, an unmodified CLCP film, will fully transmit all wavelengths within its reflection band and, therefore, the intensity of the specular reflection of such wavelengths from the background is low. In fact, in an ideal case, when the substrate is highly absorptive or highly diffusive, the specular reflection from the background area 1 is relatively very low. In area 6 and 8, however, the incident LH polarization will be transform into a RH polarization if the retarders are half-wave plates for wavelengths in the reflection band. The RH polarization will be then reflected by the RH CLCP and transformed back into LH polarization upon transmission by the half-wave retarder. The LH polarizer will transmit the reflected light and the hidden features will become visible as bright objects (6 and 8) on a dark background (1). FIG. 3*c* depicts the appearance of the hidden images 6 and 8 (assumed to be half-wave plates) embedded in a RH CLCP when viewed through a RH polarizer (11). In this case, the background 1 is fully reflects the wavelengths in the reflection band while areas 6 and 8, transmit the incident light. As a result, areas 6 and 8 appear as dark features on bright background.

In practical applications, the retardation value of the said retarder is often not exactly half wave. Nevertheless, the visibility of the hidden image is easy to achieve, since in this embodiment the reflection from background 1 can be always be made very low or very high by choosing the appropriate circular polarizer. In this embodiment it is also not necessary to overlay the circular polarizer on the optical security device. As indicated above, it is in certain respects advantageous to attach the circular polarizer to the light source far from the optical security device.

It should be noted that in this embodiment, when a circular polarizer is used to reveal the hidden images, the contrast is independent of the circular polarizer orientation. In fact, areas with retarders having their optical axes in different directions will appear as having a similar brightness. This property is particularly useful when a hidden mark comprises of retarders having different optical axes orientations but the revealing of whole image at once is important.

For example, suppose the hidden image is a ring. We also assume that the surface of background is modified into a half-wave retarder with an optical axis along arbitrary uniform direction in the plane of a RH CLCP film. The surface of the ring, however, remains unmodified. When overlaid with a RH polarizer the ring will appear bright on a dark background. Using a LH polarizer will reverse the contrast. A related example is one in which only the surface of the ring is modified into a half-wave retarder while the background remains unmodified. When overlaid with a LH polarizer the ring will appear bright on a dark background. The advantage of the latter embodiment is that the optical axis can vary continuously in any arbitrary direction throughout the ring and yet the ring will appear uniformly bright when viewed through LH polarizer. Thus, with this embodiment the surface-modification process can be performed in a way that optimizes the modification speed without any consideration to the details of the optical axes distribution within the ring.

FABRICATION PROCESS

Methods of creating the invented optical security device use a variety of physical shearing processes. These processes are compatible with industrial standard digital printing technology and, therefore, sophisticated latent images can be easily obtained.

Unlike the process disclosed in U.S. Pat. No. 6,133,980, the current invention claims that partial polymerization is a necessary condition for achieving lasting surface modification at the top layer of a CLCP film. The degree of polymerization determines the thickness being modified. For example, to create quarter-wave retarder for the visible or NIR spectrum, this partially cured layer is usually 1-3 micrometers thick. Partial polymerization can be controlled by exposing the coating on a substrate to UV radiation in an oxygen-deprived environment. The partial polymerization is required to transform the CLCP film from a liquid to a semi-solid film yet leave enough LC molecules free to reorient under external forces. Re-orientation of the partially polymerized top layer under shearing forces induces a retarder structure at the sheared surface.

Figure 4:
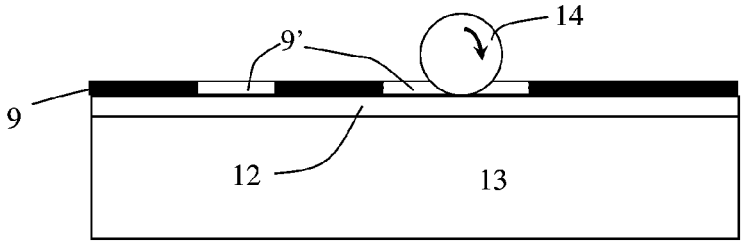
FIG. 4 depicts a mechanical buffing mechanism, such as a roller, for modifying the top layer of a partially polymerized CLCP film.

In one embodiment as described in FIG. 4, the partially polymerized CLCP film described above (12) is mechanically sheared, for example, locally by a roller (14) in a predetermined direction. The shearing direction will eventually be the direction of the optical axis of the induced optical retarder. The partial polymerization locks the CLC structure in the bulk of the film and the fully polymerized under layer (13) provide good selective reflection just like any typical CLCP films yet it leaves the exposed upper surface responsive to a shearing action. Patterning a surface retarder can be achieved by placing a physical mask (9) on top of the partially polymerized CLCP film (12). Openings in the mask (9') are the only areas where the shearing takes place. The thickness of the mask affects the resolution of the features that can be patterned by the mask. After shearing, the molecular structure at the surface of the exposed areas is no longer that of a planar cholesteric with a helical axis perpendicular to the film surface. Instead, a new molecular structure is formed that has the effective optical properties of a uniaxial optical retarder with its optical axis in the shearing direction. The mask can be removed and the whole film is then cured completely. The results are patterned retarders with a background that has no retardation.

The optical properties of the induced retarder may vary with the depth into the CLCP film. However, it acts effectively as a uniaxial retarder of a definite phase retardation value. The effective phase retardation value depends on a variety of process parameter such as: the degree of partial polymerization, the oxygen concentration during pre-curing, the force and rate of shearing, the features of the shearing tool and process temperature.

Note that in this embodiment if shearing is done without a mask, one achieves a uniform retarder on top of the CLCP.

This process embodiment has the unique advantage of creating patterned or un-patterned phase retarders as an integral part of the original CLCP film thus voiding the need to laminate a separate and expensive retarder or patterned retarder layer on top of the CLCP. It requires only one coating operation and all steps are compatible with a roll-to-roll production process. These process features make the production process of said optical security devices very affordable.

It was found in our experiments, that non-cured or under-cured CLCP coatings are not useful for mechanical shearing. Shearing of such coatings induce only temporary retardation that relaxes back to the planar CLC structure within a very short period of time. Partial polymerization of coatings on non-porous substrates can be achieved by purging inert gas during UV irradiation to avoid polymerization inhibition by oxygen. The resulting film has a fully polymerized base layer near the substrate and a partially polymerized top layer. The depth of top layer can be controlled by the amount of inert gas and the exposure dose. Shearing of CLCP films that are over-cured cannot provide sufficient retardation required by the application. Fully cured films are not responsive at all to shearing. In fact, after patterning is completed, full curing is employed to "freeze" the patterned retarders and the underlying CLCP structure to avoid any further modification or tempering with the optical security device.

In some cases of the above embodiment a second partial polymerization exposure (without a mask) may be required after the first shearing step. The entire film is then sheared in a different uniform direction (usually perpendicular to the first shearing direction) followed by a high UV dose that completely cures the LCP layer.

In another preferred embodiment for fabricating patterned retarders, the partially polymerized CLCP film is first sheared uniformly over the entire partially polymerized top layer (12) in one direction without a mask to induce a uniform surface retarder. A mask (9) is then placed on the film which protects the first retarder except at the mask openings (9'). The film is then subject to a second shearing step in a different direction (usually perpendicular to the first direction) through the mask openings (9'). The second shearing induces retarders with optical axis in the new direction. Clearly this process can be repeated with additional masks if shearing in additional different directions is required. The last mask is then removed and the entire coating is flooded with UV or with other cationic polymerization means until the film is completely cured. In such a system the last shearing action determines the final direction of the optical axis.

Mechanical shearing mechanism includes but not limited to: buffing with cloth, brush, or any kind of materials that have fine hair texture; stamping while the substrates are moving; smearing etc.

Figure 5:
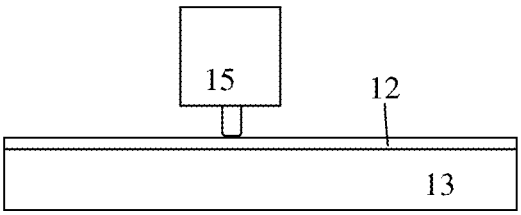
FIG. 5 is illustrates a pen-plotting mechanism for modifying the top layer of a partially polymerized CLCP film.

In the next two embodiments a sharp tip shears the top surface of a partially polymerized CLCP film, similar to writing with a pen. This is a way for patterning single line features of higher resolution than in the previous embodiments. Tip-shearing allow for easy customization of the invisible marks and enables serialization—printing consecutive different invisible marks. Printing a long series of different barcode labels is an example of serialization ability. In the following embodiments, a pen-plotter head (15), as shown in FIG. 5, which can move in the plane of the film, is controlled by a computer, or a CNC (Computer Numerical Control) machine. The tip of the pen is rounded to produce fine lines. During the operation the pen moves above the partially polymerized CLCP coating (12) with a controlled pressure and speed, and barely touches the surface of the coating. The result is a computer generated retardation pattern which is written on top of the CLCP film (12). In this embodiment no mask is needed. If features wider than a single line are required, they can be drawn in a raster fashion.

Figure 6A:
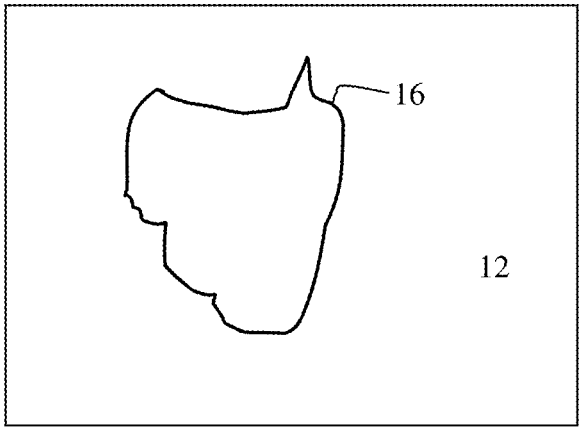
FIG. 6*a* shows an arbitrary curve plotted by a pen plotter in a continuous mode.
Figure 6B:
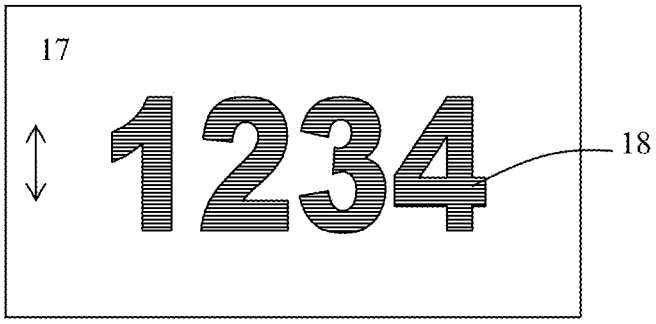
FIG. 6*b* shows images plotted by a pen-plotter in a raster mode.

FIGS. 6*a*, 6*b* illustrate the plotting of retardation patterns generated by a pen-plotter on a partially polymerized CLCP film (12). There are two ways of making these patterns: a continuous mode, or a raster mode.

In the continuous mode embodiment a top view as shown in FIG. 6*a*, the pen head (not shown) moves continuously with a single stroke plotting one-line curve (16). The rest of the area (12) remains unaltered. Note that in this case the local optical axis is tangential to the drawn curve and thus varies with the curve direction. A full polymerization is needed after the pen-drawing step. To view the drawn feature (preferable a half-wave retardation line), a circular polarizer is required, as only with such a polarizer the curve brightness appears uniform. The polarizer's handedness is chosen to be opposite to the CLCP handedness to visualize a bright curve on a dark background.

The preferred embodiment of the raster mode is one in which the invisible mark is made by raster shearing of half-wave retardation lines while the background remains unmodified. The shearing step is followed by complete curing. A circular polarizer of handiness opposite to the CLCP handiness is used to visualize the hidden mark as a bright mark on a dark background. A complete polymerization step is needed to freeze the invisible mark.

In another raster mode as shown in FIG. 6*b*, the whole film is first sheared in a uniform direction to induce a quarter-wave retarder (17). FIG. 6*b* depicts a top view of a raster mode shearing for fabricating a feature (18) wider then a single line. The raster shearing induces quarter-wave retarders with a uniform optical axes parallel to the raster lines and perpendicular to the optical axis of the background (17). A linear polarizer is required to visualize the feature. A complete polymerization step is needed to freeze the invisible mark.

A top coating is necessary to make the mechanical shearing marks invisible to the naked eye and to protect the patterned retarders. The materials used for top coating include transparent or semi-transparent polymers, dye-doped polymers, etc, preferably materials that have similar index of refraction as the average index of refraction of the CLCP.

What is claimed is:

1. A method of making an optical device containing patterned anisotropic phase retardation elements by a selective surface modification of a single cholesteric liquid crystal polymer (CLCP) layer, said method comprises the following steps:

step 1—coating a CLC mixture on a substrate to form a CLC layer;

step 2—partially polymerizing the entire said CLC layer by exposing it to ultraviolet radiation to form a CLCP layer;

step 3—optionally surface modifying the entire said partially polymerized CLCP layer in a first direction at the CLCP-air interface;

step 4—surface modifying said partially polymerized CLCP layer at the CLCP-air interface in selected areas in a second direction or in a plurality of other distinct directions;

step 5—completely polymerizing said partially polymerized and surface modified CLCP layer; and step 6—applying a top coating onto said surface-modified and completely polymerized CLCP layer at the CLCP-air interface.

2. A method of making surface-modified CLCP film as in steps 3 and 4 of claim 1, where the surface modification comprises a mechanical shearing action.

3. A method of making surface-modified CLCP film as in steps 3 and 4 of claim 1, where the surface modification is done by buffing said partially polymerized CLCP with a roller.

4. A method of making surface-modified CLCP film as in step 4 of claim 1, where the surface modification of said selected areas is done by buffing said partially polymerized CLCP through mechanical openings in a physical mask.

5. A method of making surface-modified CLCP film as in step 4 of claim 1, where the surface modification of said selected areas is done using a mechanical tip to plot continuous lines.

6. A method of making surface-modified CLCP film as in step 4 of claim 1, where the surface modification of said selected areas is done using a mechanical tip to plot raster lines.

7. A method of making surface-modified CLCP film as in claim 1, excluding step 3, where the resulting film has a reflection band with a certain bandwidth, and where the polarization state of the reflected light is either right-(left-) handed circularly polarized in the un-modified areas, and left- (right-) handed circularly polarized or linearly polarized in the modified areas.

8. A method of making surface-modified CLCP film as in steps 3 and 4 of claim 1, where the first and second buffing directions are mutually perpendicular.

* * * * *